US011459767B1

(12) United States Patent
Riley

(10) Patent No.: US 11,459,767 B1
(45) Date of Patent: Oct. 4, 2022

(54) EXTERIOR FINISHING SYSTEMS FOR BUILDINGS AND RELATED METHODS OF USE

(71) Applicant: Richard Riley, Birmingham, AL (US)

(72) Inventor: Richard Riley, Birmingham, AL (US)

( * ) Notice: Subject to any disclaimer, the term of this patent is extended or adjusted under 35 U.S.C. 154(b) by 0 days.

(21) Appl. No.: 17/382,553

(22) Filed: Jul. 22, 2021

Related U.S. Application Data

(60) Provisional application No. 63/054,992, filed on Jul. 22, 2020.

(51) Int. Cl.
*E04F 13/04* (2006.01)
*E04B 1/80* (2006.01)
*E04B 1/76* (2006.01)

(52) U.S. Cl.
CPC ..... *E04F 13/045* (2013.01); *E04B 1/7629* (2013.01); *E04B 1/80* (2013.01)

(58) Field of Classification Search
CPC ..... E04F 13/045; E04B 1/7629; E04B 1/80
See application file for complete search history.

(56) References Cited

U.S. PATENT DOCUMENTS

| | | | | |
|---|---|---|---|---|
| 7,625,827 | B2 * | 12/2009 | Egan | E04F 13/04 52/408 |
| 9,649,663 | B2 * | 5/2017 | Strachan | B28B 1/52 |
| 9,970,192 | B2 * | 5/2018 | Ravellette | F24S 10/00 |
| 2010/0215969 | A1 * | 8/2010 | Brandenburger | C04B 41/63 427/508 |
| 2011/0258944 | A1 * | 10/2011 | Radoane | E04B 1/6803 52/220.8 |
| 2014/0087158 | A1 * | 3/2014 | Ciuperca | B32B 3/266 428/223 |
| 2014/0260034 | A1 * | 9/2014 | Ciuperca | E04C 5/125 52/405.3 |
| 2014/0272302 | A1 * | 9/2014 | Ciuperca | E04F 13/02 428/150 |
| 2020/0123765 | A1 * | 4/2020 | Campacci | E04B 2/56 |
| 2021/0095469 | A1 * | 4/2021 | Overman | E04C 2/22 |

* cited by examiner

*Primary Examiner* — Patrick J Maestri
(74) *Attorney, Agent, or Firm* — Taylor English Duma LLP

(57) ABSTRACT

An exterior finishing system for a building is disclosed herein. The exterior finishing system may include a panel comprised of high density closed-cell foam, the panel securable to a substrate of a building. The exterior finishing system may further include a bonding layer disposed upon a surface of the panel, the bonding layer comprising water and acrylic polymer. The exterior finishing system may further include an exterior layer comprising calcium carbonate disposed upon a surface of the bonding layer. Methods of use of the exterior finishing system are also disclosed.

5 Claims, 3 Drawing Sheets

EXTERIOR FINISHING SYSTEMS FOR BUILDINGS AND RELATED METHODS OF USE

CROSS-REFERENCE TO RELATED APPLICATIONS

The present application claims priority to and benefit of U.S. Provisional Patent Application No. 63/054,992 filed Jul. 22, 2020, which is hereby incorporated by reference in its entirety herein.

FIELD OF THE INVENTION

The present invention relates to finishing systems for the exterior of building structures and the like.

BACKGROUND OF THE INVENTION

The exterior structural supports of a building are typically covered with a substrate, such as plywood, to which an exterior material is attached. Building, as used herein, may include, for example, a house as well as various single and multi-story commercial or industrial buildings. A surface of the exterior material then forms an exterior surface of the building. It is important that the exterior material is durable and resistant to damage from environmental conditions, such as moisture and temperatures. However, the exterior material in combination with materials used to attach the exterior material to the substrate may be difficult to store, transport, handle, and install. Accordingly, there is a need for improved exterior finishing systems including an exterior layer and materials used to attach the exterior layer to the substrate of the structure.

BRIEF SUMMARY OF THE INVENTION

These and other needs and disadvantages may be overcome by the compositions of matter and related methods of use disclosed herein. Additional improvements and advantages may be recognized by those of ordinary skill in the art upon study of the present disclosure.

In various aspects, an exterior finishing system for a building is disclosed herein. The exterior finishing system, in various aspects, includes a panel comprised of high density closed-cell foam, the panel securable to a substrate of a building. The exterior finishing system, in various aspects, further includes a bonding layer disposed upon a surface of the panel, the bonding layer comprising water and acrylic polymer. The exterior finishing system, in various aspects, further includes an exterior layer comprising calcium carbonate disposed upon a surface of the bonding layer.

Methods of use of the exterior finishing system are disclosed herein. In various aspects, the methods of use include the step of disposing a bonding layer upon a surface of a panel, the bonding layer comprising water and acrylic polymer. The methods of use may include the step of disposing an exterior layer comprising calcium carbonate upon a surface of the bonding layer and the step of securing the panel to a substrate of a building, in various aspects.

This summary is presented to provide a basic understanding of some aspects of the apparatus and methods disclosed herein as a prelude to the detailed description that follows below. Accordingly, this summary is not intended to identify key elements of the apparatus and methods disclosed herein or to delineate the scope thereof.

Figure 1A:
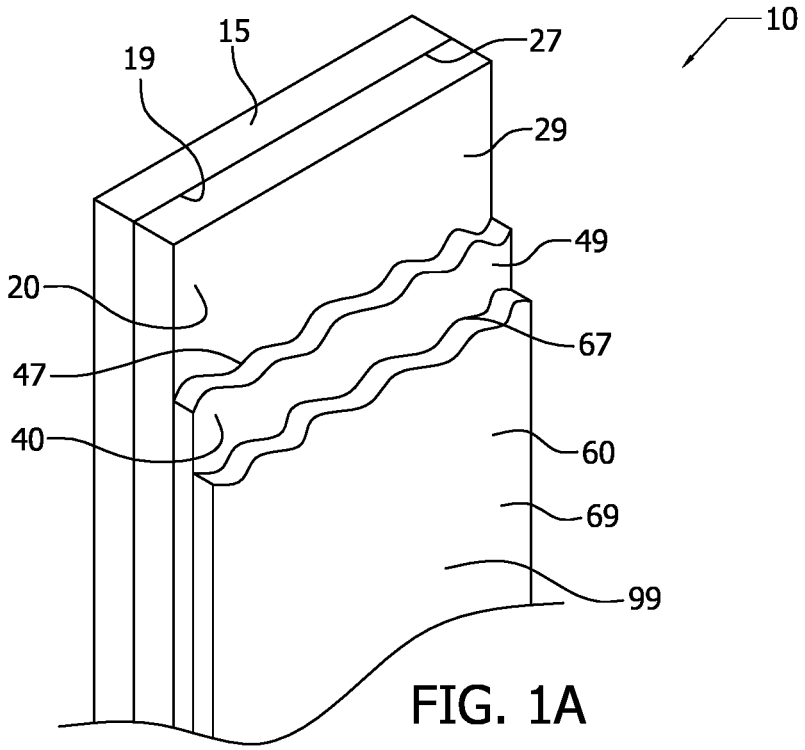
FIG. 1A illustrates by cut-away perspective view an exemplary exterior finishing system according to aspects of the present inventions.

The Figures are exemplary only, and the implementations illustrated therein are selected to facilitate explanation. The number, position, relationship and dimensions of the elements shown in the Figures to form the various implementations described herein, as well as dimensions and dimensional proportions to conform to specific force, weight, strength, flow and similar requirements are explained herein or are understandable to a person of ordinary skill in the art upon study of this disclosure. Where used in the various Figures, the same numerals designate the same or similar elements. Furthermore, when the terms "top," "bottom," "right," "left," "forward," "rear," "first," "second," "inside," "outside," and similar terms are used, the terms should be understood in reference to the orientation of the implementations shown in the drawings and are utilized to facilitate description thereof. Use herein of relative terms such as generally, about, approximately, essentially, may be indicative of engineering, manufacturing, or scientific tolerances such as ±0.1%, ±1%, ±2.5%, ±5%, or other such tolerances, as would be recognized by those of ordinary skill in the art upon study of this disclosure.

DETAILED DESCRIPTION OF THE INVENTION

Figure 1B:
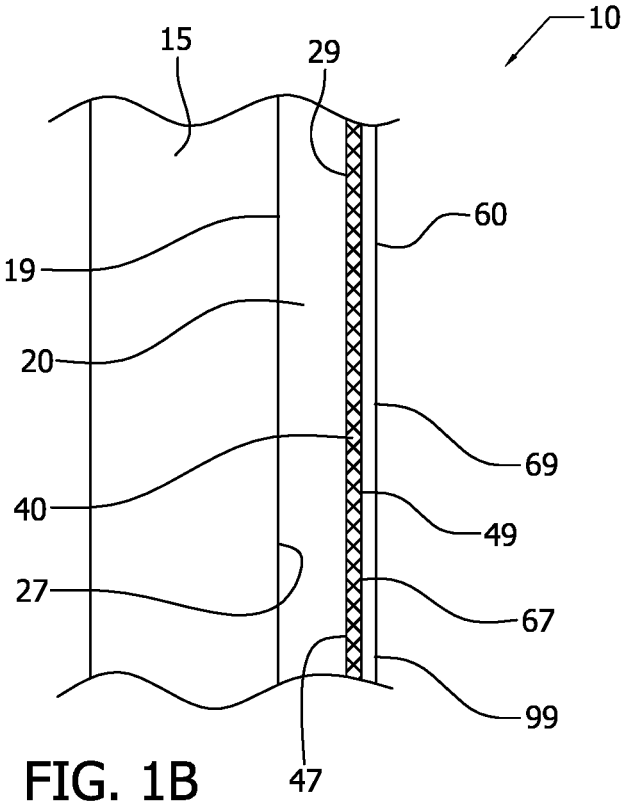
FIG. 1B illustrates by planar cross-sectional view the exemplary exterior finishing system of FIG. 1A.

FIGS. 1A and 1B illustrate exemplary exterior finishing system 10. As illustrated, exterior finishing system 10 includes substrate 15 with substrate surface 19 thereof overlayed by panel 20. Bonding layer 40 then overlays panel 20, and exterior layer 60 overlays bonding layer 40, as illustrated. Thus, in the implementation of FIGS. 1A, 1B, panel 20, bonding layer 40, and exterior layer 60 are in successive overlayed engagement with one another to successively overlay substrate surface 19 of substrate 15 with surface 69 of exterior layer 60 thereby forming an exterior surface 99 of a structure such a commercial building or a house.

Substrate 15, for example, may be formed of plywood, concrete, insulating material, water barrier material, combinations thereof, and so forth, as would be readily recognized by those of ordinary skill in the art upon study of this disclosure. Substrate 15 may be anchored to various structural members (not shown) such as wooden, steel, or aluminum framing, concrete structures, and so forth, as would be readily recognized by those of ordinary skill in the art upon study of this disclosure. Substrate 15 may be formed of wooden, steel, or aluminum framing, in various implementations.

Panel 20 overlays substrate 15 with surface 27 of panel 20 oriented toward substrate surface 19 of substrate 15, as illustrated. In some implementations, surface 27 of panel 20 is in biased engagement with substrate surface 19 of substrate 15, while, in other implementations, surface 27 of panel 20 is offset, at least in part, from substrate surface 19 of substrate 15, for example, to form an air gap between surface 27 and substrate surface 19. Panel 20 may be attached to substrate 15 by various fasteners such as clips, nails, screws, adhesives, and so forth, as would be readily recognized by those of ordinary skill in the art upon study of this disclosure. In certain implementations, a flat aluminum bar is used to keep the foam board panels in plane and to serve as a mechanical sealant backer rod. A plurality of 0.25-inch aluminum clips are then used to anchor the foam board panels to the wall with standard Z-clips.

Panel 20 may be formed as a sheet of a composite comprising a high density, closed-cell foam such as a polyurethane foam and the foam may be reinforced with fiberglass. For example, panel 20 may be formed, at least in part, using ENERFOAM available from The Dow Chemical Company.

Bonding layer 40 is formed as a coating bonded to panel 20 with surface 47 of bonding layer 40 overlaying surface 29 of panel 20, as illustrated. In various implementations, the bonding layer 40 includes water, acrylic polymer, and octylphenol ethoxylate. An exemplary acrylic polymer as may be comprised by bonding layer 40 is commercially available from The Dow Chemical Company under the name Rhoplex EI-2000. An exemplary octylphenol ethoxylate as may be comprised by bonding layer 40 is commercially available from The Dow Chemical Company under the name Triton X. Bonding layer 40 may include other materials such as, for example, anti-foaming agents, antimicrobials, pigments, and the like (see exemplary compositions given in Table 1 and Table 2 below).

Another exemplary composition of bonding layer 40 is given in Table 1.

TABLE 1

| Ingredient | % By Weight |
|---|---|
| water | 22.76 |
| ethyl hydroxyethyl cellulose | 0.38 |
| Foamaster NXZ | 0.05 |
| Ammonia | 0.16 |
| acrylic polymer | 13.79 |
| #44 sand | 59.97 |
| G260 | 2.84 |
| Proxel GXL | 0.05 |

Ethyl hydroxyethyl cellulose is commercially available as Bermocoll® E 481 FQ by Nouryon. Ethyl hydroxyethyl cellulose acts as a rheology modifier, and may be suitable for use in latex paints for thickening and stabilizing effects. Ethyl hydroxyethyl cellulose is non-ionic, water soluble and helps improve the consistency, stability and water retention of water-based products.

Foamaster® NXZ, commercially available from BASF, is a blend of hydrocarbons and non-ionic surfactants. Used as a defoamer for emulsion adhesives. Compatible with styrene-butadiene, acrylic, polyvinyl chloride and its copolymers, ethylene vinyl acetate, vinylidene chloride and water-soluble alkyds.

Proxel GXL antimicrobial is a broad spectrum biocide for the preservation of industrial water-based products against spoilage from bacteria, yeasts and fungi comprising aqueous dipropylene glycol solution of 1,2-benzisothiazolin-3-one. Available commercially from Lonza Monson Co of Leominster Mass.

G260 is commercially available from Huber Engineered Materials and comprises a calcium carbonate. G260 may act as an extender, gloss control agent, anti-slip additive, rheology modifier and densifier.

Yet another exemplary composition of bonding layer 40 is given in Table 2.

TABLE 2

| Ingredient | % By Weight |
|---|---|
| Water | 15.18 |
| acrylic polymer | 34.72 |
| Tamol 851 | 0.09 |
| Propylene Glycol | 0.17 |
| TyloseHP 15000YP2 | 0.28 |
| Foamaster NXZ | 0.15 |
| RCL 596 | 8.90 |
| G260 | 28.34 |
| Ester alcohol | 1.91 |
| Proxel GXL | 0.09 |
| Zinc Omadine ZOE | 0.09 |
| Ammonia | 0.09 |
| Foamaster NXZ | 0.12 |

Tamol™ 851, which is commercially available from The Dow Chemical Company, is a formaldehyde-free polyacid dispersant for flats through semi-gloss latex paints.

Tylose® H15000 YP2 is a water-soluble, non-ionic hydroxyethyl cellulose powder with standard etherification, and is commercially supplied by SE Tylose GmbH & Co. KG.

RCL 596 is a multipurpose chloride-process rutile titanium dioxide pigment designed for use in both aqueous and solvent based coating systems. RCL 596 may be characterized by a combination of gloss, color and dispersibility coupled with high exterior durability. RCL 596 is commercially available from INEOS Pigments of Glen Burnie, Md.

Ester alcohol is a coalescent for latex paints available as Texanol from Eastman Chemical Company.

Zinc Omadine® ZOE by Lonza is a dry film and in-can preservative for water-based paints. Also used as a dry film preservative for marine anti-fouling paints. It is a highly active, broad spectrum zinc complex of pyrithione.

As illustrated, surface 67 of exterior layer 60 overlays surface 49 of bonding layer 40 in biased adhesive attachment, and surface 69 of exterior layer 60 forms the exterior surface 99. Exterior layer 60 is thus attached adhesively to bonding layer 40, bonding layer 40 is bonded to panel 20, and panel 20 is attached to substrate 15 thereby securing exterior layer 60 to substrate 15, in this implementation.

Exterior layer 60 may comprise calcium carbonate including other cementitious materials. Surface 69, which forms exterior surface 99 of the structure, may be configured to have an aesthetically pleasing appearance. For example, surface 69 of exterior layer 60 may have a faux finish with an appearance of brick, metal panel, stucco, stone, wood, and the like, in various implementations. Exterior layer 60 may comprise materials of which bonding layer 40 is comprised. For example, exterior layer 60 may include pigments, acrylics, dispersants, sand (such as #44 sand), acrylic, anti-biologics, surfactants, rheologic agents, and so forth.

Figure 2:
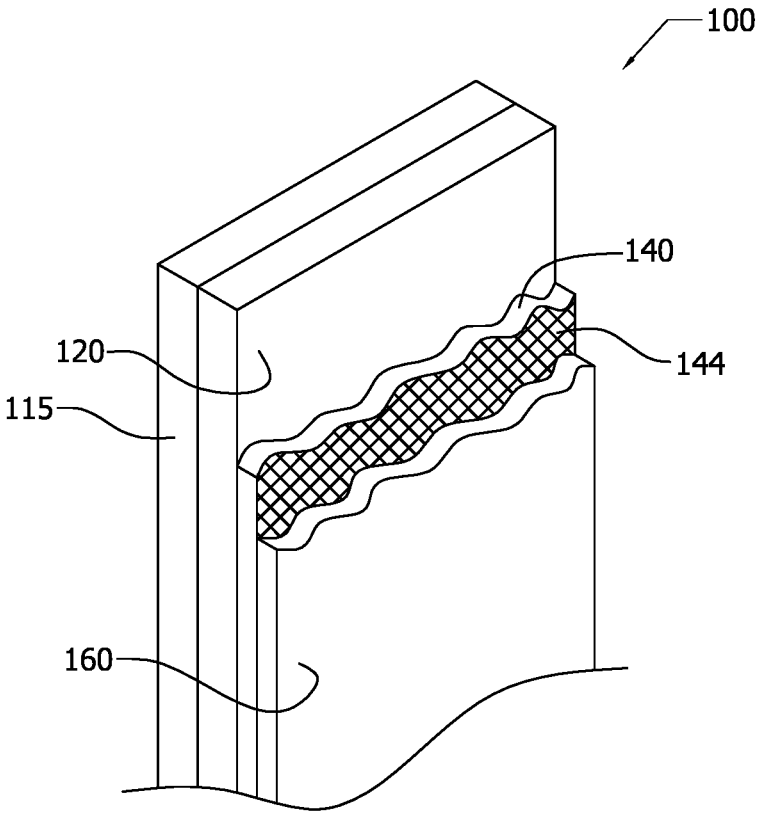
FIG. 2 illustrates by cut-away perspective view another exemplary exterior finishing system according to aspects of the present inventions; and, FIG. 3 illustrates by process flow chart an exemplary method of use of an exemplary exterior finishing system according to aspects of the present inventions.

FIG. 2 illustrates exemplary exterior finishing system 100. As illustrated, exterior finishing system 100 includes substrate 115 overlayed by panel 120. Bonding layer 140 then overlays panel 120, and exterior layer 160 overlays bonding layer 140, as illustrated. Substrate 115, panel 120, and exterior layer 160 may be configured generally as substrate 15, panel 20, and exterior layer 60 of exterior finishing system 10, respectively, in various implementations. Bonding layer 140, in exemplary exterior finishing system 100, includes reinforcing layer 144 as reinforcement while otherwise being formed generally similarly to bonding layer 40 of exterior finishing system 10, in this exemplary implementation. Reinforcing layer 144 may include various meshes, screens, or other reinforcement, and reinforcing layer 144 may be fabricated from metal, various plastics, fiberglass, or combinations thereof, in various implementations.

Figure 3:
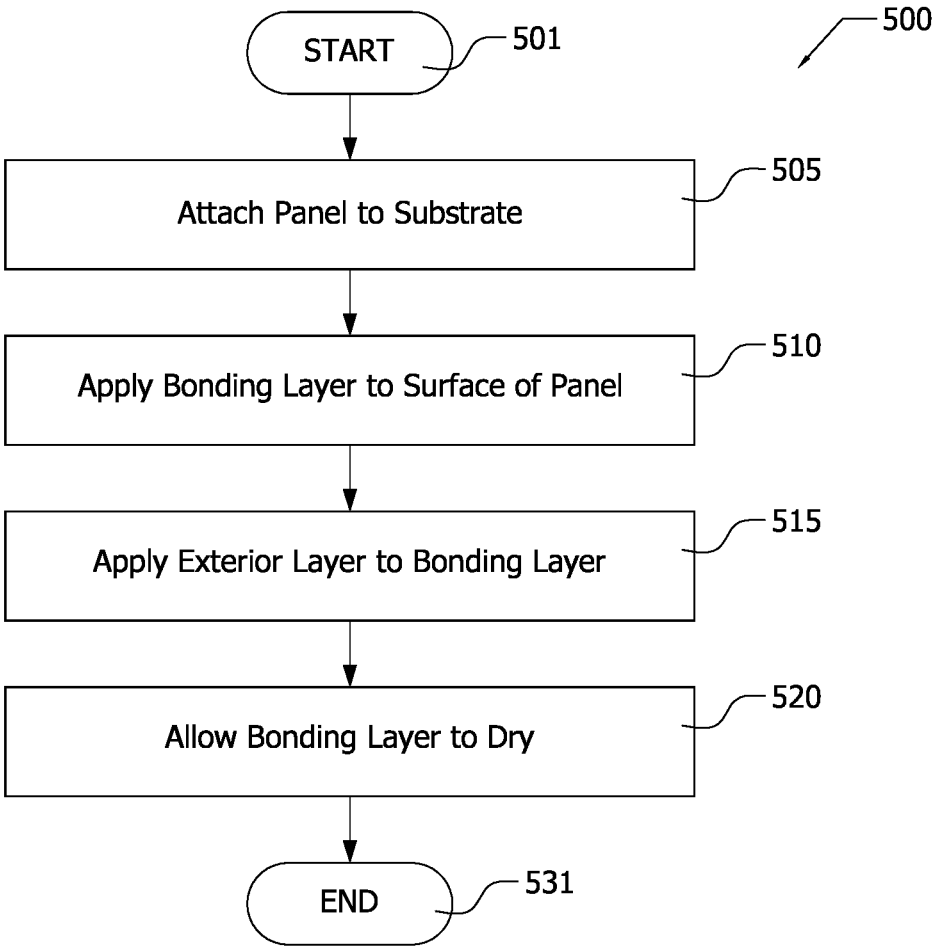

In operation, an exterior finishing system, such as exterior finishing system 10, 100, may be used to secure an exterior layer, such as exterior layer 60, 160, to a substrate, such as substrate 15, 115 as indicated by exemplary method 500 shown in FIG. 3. In method 500 it is assumed that the substrate is anchored in place to various structural members (not shown) of a building. Method 500 is entered at step 501.

At step 505, one or more panels, such as panels 20, 120, are attached to the substrate. When multiple panels are attached to the substrate, the panels may be engaged with one another by glued tongue and groove connections.

At step 510, a bonding layer, such as bonding layer 40, 140 is applied to a surface, such as surface 29, of the panel(s). The bonding layer may be applied to the panel(s) by trowel including roller, brush, sprayer, screed, and other such tools. A reinforcing layer, such as reinforcing layer 144, may be included in the bonding layer, in certain implementations.

At step 515, the exterior layer is applied over the bonding layer thereby attaching adhesively the exterior layer to the bonding layer. The exterior layer may be applied by trowel, and a surface, such as surface 69, of the exterior layer may be configured to have various appearances such as a faux finish. The bonding layer may be generally liquid or plastic during steps 510, 515.

At step 520, the bonding layer is allowed to dry thereby solidifying, and, thus, adhesively attaching the exterior layer to the panel and thus to the substrate. The exterior layer may be textured or otherwise formed into the faux finish of an exterior surface, such as exterior surface 99.

Method 500 Terminates at Step 531.

In other exemplary operational implementations, panel(s) inclusive of the bonding layer and the exterior layer may be attached to the substrate. In such implementations, fabrication of panels that include the bonding layer and the exterior layer may be performed according to steps 510, 515, 520 of method 500 off site, and the panels with bonding layer and exterior layer attached thereto then transported from off site to the structure for attachment to the substrate of the structure per step 505. An assembly of multiple panels may be formed with bonding layer and exterior layer attached thereto and then transported from off site to the structure for attachment to the substrate. In such implementations, the sequence of steps is therefore 510, 515, 520, 505. The combination of panel, bonding layer, and exterior layer may be about 80% lighter than the typical cement/acrylic based panels currently used in exterior finishing of building structures.

The foregoing discussion along with the Figures discloses and describes various exemplary implementations. These implementations are not meant to limit the scope of coverage, but, instead, to assist in understanding the context of the language used in this specification and in the claims. The Abstract is presented to meet requirements of 37 C.F.R. § 1.72(b) only. Accordingly, the Abstract is not intended to identify key elements of the apparatus and methods disclosed herein or to delineate the scope thereof. Upon study of this disclosure and the exemplary implementations herein, one of ordinary skill in the art may readily recognize that various changes, modifications and variations can be made thereto without departing from the spirit and scope of the inventions described herein and defined in the following claims.

The invention claimed is:

1. An exterior finishing system for a building, comprising:
   a. a panel comprised of high density closed-cell foam, the panel securable to a substrate of a building;
   b. a bonding layer disposed upon a surface of the panel, the bonding layer comprising water and acrylic polymer; and
   c. an exterior layer comprising calcium carbonate disposed upon a surface of the bonding layer.

2. The system of claim 1, wherein the exterior layer is formed into a faux finish.

3. A method for forming an exterior surface of a building, comprising the steps of:
   a. bonding a bonding layer onto a surface of a panel, the bonding layer comprising water and acrylic polymer;
   b. attaching an exterior layer comprising calcium carbonate onto a surface of the bonding layer; and
   c. securing the panel to a substrate of a building.

4. The method of claim 3, wherein the steps are performed in a sequence, the sequence being step a, then step b, then step c.

5. The method of claim 3, wherein the steps are performed in a sequence, the sequence being step c, then step a, then step b.

* * * * *